US011305842B1

(12) United States Patent
Haas

(10) Patent No.: US 11,305,842 B1
(45) Date of Patent: Apr. 19, 2022

(54) INDEPENDENT STRUCTURAL MEMBER DRAIN CHANNELS

(71) Applicant: Benjamin S. Haas, Ottsville, PA (US)

(72) Inventor: Benjamin S. Haas, Ottsville, PA (US)

( * ) Notice: Subject to any disclaimer, the term of this patent is extended or adjusted under 35 U.S.C. 154(b) by 42 days.

(21) Appl. No.: 16/816,960

(22) Filed: Mar. 12, 2020

Related U.S. Application Data

(60) Provisional application No. 62/817,263, filed on Mar. 12, 2019.

(51) Int. Cl.
*B63B 13/02* (2006.01)

(52) U.S. Cl.
CPC ..... *B63B 13/02* (2013.01)

(58) Field of Classification Search
CPC ..... B63B 13/00; B63B 13/02; B63B 3/70; B63B 5/24; B63B 3/54; B63B 19/26; B63B 19/22; B63H 20/007
USPC ..... 114/357
See application file for complete search history.

(56) References Cited

U.S. PATENT DOCUMENTS 3,834,340 A * 9/1974 Thorpe ..... B63B 1/04 114/201 R
2020/0298453 A1* 9/2020 Coleman ..... B29C 41/20

* cited by examiner

*Primary Examiner* — Anthony D Wiest
(74) *Attorney, Agent, or Firm* — Wilkinson Law Office; Clinton H. Wilkinson

(57) ABSTRACT

An article of manufacture including molded-in notches in the peripheral edge of long, uninterrupted molded-in compartments in a rotational molded boat hull for permitting the flush fitting of certain independent structural members in said notches to provide both structural support and drainage of water away from seams between adjacent deck panels and hatches secured over the compartments without resorting to elaborate pre-fabricated decks. The article of manufacture includes a body, wherein the body is a plastic molded boat hull comprised of numerous molded-in cavities and molded-in features to create an interior layout that is comparable to a conventional boat built of aluminum or fiber reinforced plastic.

19 Claims, 6 Drawing Sheets

INDEPENDENT STRUCTURAL MEMBER DRAIN CHANNELS

CROSS REFERENCE TO RELATED APPLICATION

This application claims the benefit of U.S. Provisional Patent Application Ser. No. 62/817,263 filed on Mar. 12, 2019, the entirety of which is now incorporated herein by reference.

FIELD OF THE INVENTION

The present invention relates to systems and methods for the construction of rotational molded plastic-hulled power boats, and more particularly to a system and method for supporting deck panels and hatches over long, uninterrupted compartments in a rotational molded boat hull that facilitate the drainage of water away from the seams between adjacent panels without resorting to elaborate pre-fabricated decks, and including a series of independent structural member drain channels which extend between the seams for such purpose.

BACKGROUND OF THE INVENTION

In the pursuit of applying rotational molding to the construction of plastic-hulled power boats, there are certain unique problems inherent to rotational molding that must be surmounted in order to make rotationally molded plastic-hulled power boats that can compete on quality, performance, and price with conventional power boats constructed of aluminum, or fiber reinforced plastic (FRP). One of these problems concerns the installation of deck panels and deck hatches over the tops of molded-in compartments that are too large for a single hatch to be practical. This requires these deck panels and associated hatches to be broken up into separate, smaller panels, resulting in seams between each panel that can allow the ingress of water into the compartment.

In conventional aluminum and FRP boat construction, such large compartments can have drain channels molded into the FRP deck or fabricated out of aluminum and installed around the lip of the compartments without interfering with the space inside the compartments. In rotational molding a boat, however, where the boundaries of compartments and their associated drain channels are molded integrally with the hull, the only way to add a drain channel to a large, oversized compartment is to divide the compartment into separate smaller cavities by molding in structural walls with drain channels at the top. This solution, however, is not satisfactory for a plastic fishing boat of conventional arrangement as it destroys the utility of having large, uninterrupted compartments. Such large, uninterrupted compartments are needed for the storage of long items such as fishing rods, landing nets, oars, etc. This problem must be viewed in terms of the reasons for using rotational molding as an advantageous alternative to aluminum and FRP construction.

The primary advantage of using rotational molding for the construction of power boat hulls is the drastic reduction in labor required to create hydrodynamic hulls with compound curvature. These hull characteristics are otherwise only achieved with FRP, while aluminum boat construction is practically restricted to flat panels and significantly simpler curvature. In rotational molding, when the sealed mold is filled with powdered plastic and placed in the oven, the oven does the work of molding the hull, not teams of welders, or fiberglass workers laying mat and rolling resin. An additional advantage of using rotational molding for the construction of power boat hulls is the ability to include numerous molded-in longitudinal and transverse structures that provide both global and local structural reinforcement of the hull and decks, and create compartments for storage, thereby avoiding the need for elaborate pre-fabricated decks that FRP and aluminum must use.

If rotational molded power boats are to compete in quality and performance against conventional boats made of aluminum or FRP, they must be able to achieve long, uninterrupted storage compartments with practically-sized hatches and proper water tightness between the seams of said hatches and surrounding deck structure. In addition, if rotational molded power boats are to compete in price against conventional boats constructed of aluminum or FRP, they must be able to achieve these long, uninterrupted compartments without resorting to costly pre-fabricated decks that run counter to the cost savings of being able to mold all deck-supporting structures integrally with the hull. Recognizing that the key economic advantage of rotational molding over aluminum or FRP construction is the ability to mold the hull and deck-supporting structure as one integral piece of plastic, the present invention provides a system for supporting deck panels and hatches over long, uninterrupted compartments in a rotational molded boat hull that allow the drainage of water away from the seams between said panels without resorting to elaborate pre-fabricated decks.

SUMMARY OF THE INVENTION

The present invention relates to a generic power boat hull that is rotationally molded out of plastic, utilizing a combination of numerous male cavities, kiss-offs and other molded-in features integral with the hull to create an interior layout that is comparable to a conventional boat built of aluminum or FRP. In addition, the extensive use of the aforementioned molded-in features avoids the need for elaborate pre-fabricated decks, and avoids the need to cut into the molded hull to run cables, hoses, etc, thereby preserving the labor savings inherent to rotational molding a boat hull versus aluminum or FRP construction. This includes several long, uninterrupted male cavities on the port and starboard sides of the hull, each intended to act as storage compartments.

One particular side-effect of the aforementioned molded-in features is the need to provide practical-sized hatches for these long, uninterrupted compartments that would otherwise result in open seams between the hatches and surrounding deck, resulting in both the ingress of water into the compartments and lack of structural support at those seams. In the present invention, notches are molded into perimeter drain channels which extend around the periphery of each compartment at locations where seams in the deck panels occur. These molded-in notches enable a method of installing independent structural members beneath the decks and under the seams. These independent structural members are affixed to the plastic hull either via fasteners connected directly to the plastic, or via fasteners connected to inserts molded into the plastic. The independent structural members can be made of any suitably strong material, but typically would be structural grade aluminum or steel. In addition, these independent structural members can be fitted with a sealing member on opposing ends down the length of the member, spaced apart wider than the seam in the deck, allowing the entrapment of water that falls onto the independent structural member through the seam, and the subsequent drainage of said water away from the compartment. The molded-in notches are designed such that the installed independent structural member drain channels both structurally support the deck panels and provide a watertight seal between the sealing member and deck panel.

Further areas of applicability of the present invention will become apparent from the detailed description provided hereinafter.

BRIEF DESCRIPTION OF THE DRAWINGS

The present invention will become more readily understood from the detailed description in conjunction with the accompanying drawings, wherein like reference numerals designate like structural elements, and wherein.

DETAILED DESCRIPTION

Reference will now be made in detail to representative embodiments of the present invention as illustrated in the accompanying drawings. The following descriptions are not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
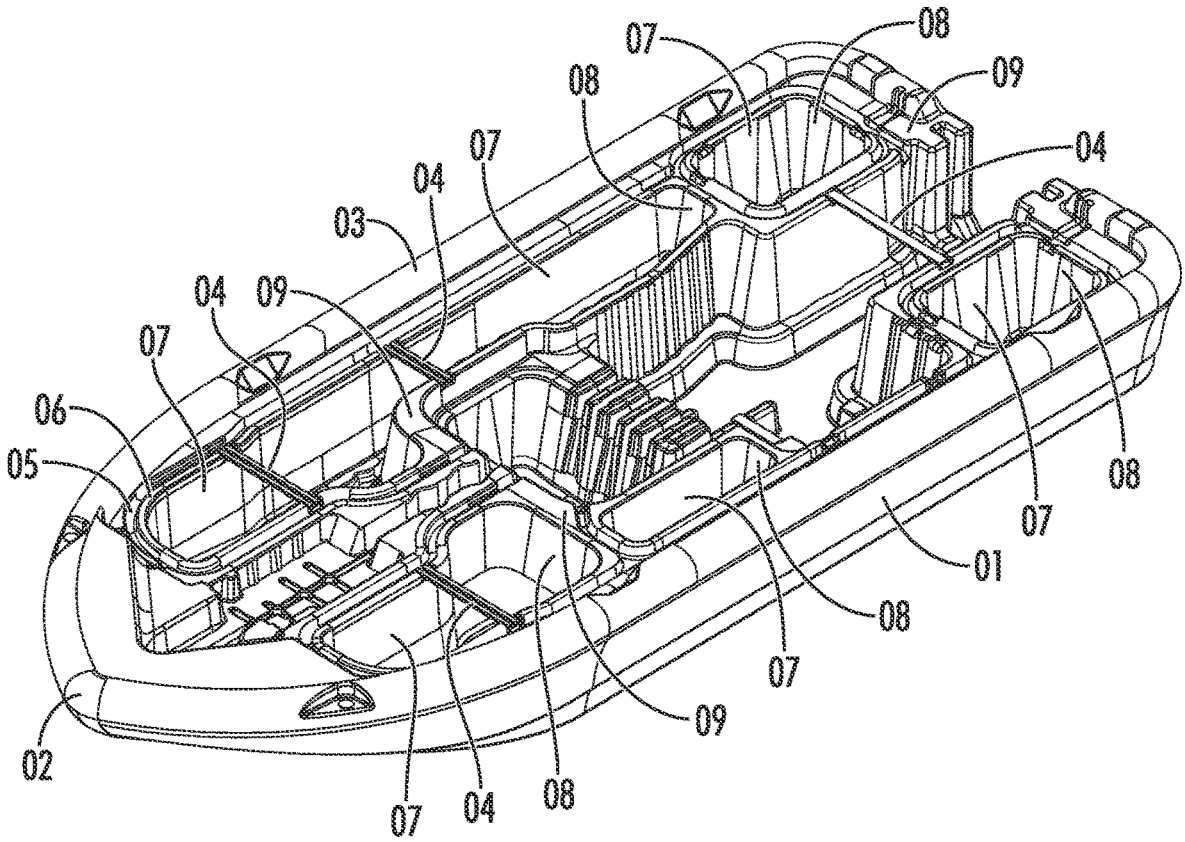
FIG. 1 is a perspective view of a generic rotational molded fishing boat containing the molded-in features and independent structural member drain channels of the present invention.

With further reference to the drawings, a generic rotational molded fishing boat is depicted in FIG. 1. The rotational molded fishing boat utilizes numerous male cavities, kiss-offs, and various molded-in features to achieve an internal layout of close similarity to that of boats built of aluminum or FRP. The rotational molded boat illustrated in FIG. 1 can be manufactured from various materials suitable for the rotational molding process, but would typically be made of high density polyethylene.

As shown in FIG. 1, the boat includes an outer hull indicated generally by numeral 01, having a bow 02 and molded-in port and starboard gunwales indicated generally by the numeral 03 for the starboard gunwale. Molded-in longitudinal vertical walls are indicated generally by numeral 07 and molded-in transverse vertical walls are indicated generally by numeral 08. These vertical walls 07 and 08 define the boundaries of the various molded-in male cavities comprising the boat storage compartments. Molded-in horizontal flat surfaces are indicated generally by numeral 09 and provide both structural support and mounting surfaces for deck panels. Molded-in raised lips and cavities extend around portions of the perimeters of the various molded in storage compartments and form drain channels around said compartments. The raised lips of the aforementioned drain channels are indicated generally by numeral 06, whereas the cavities of the drain channels are indicated generally by the numeral 05. The independent structural member drain channels are indicated generally by numeral 04.

Figure 2:
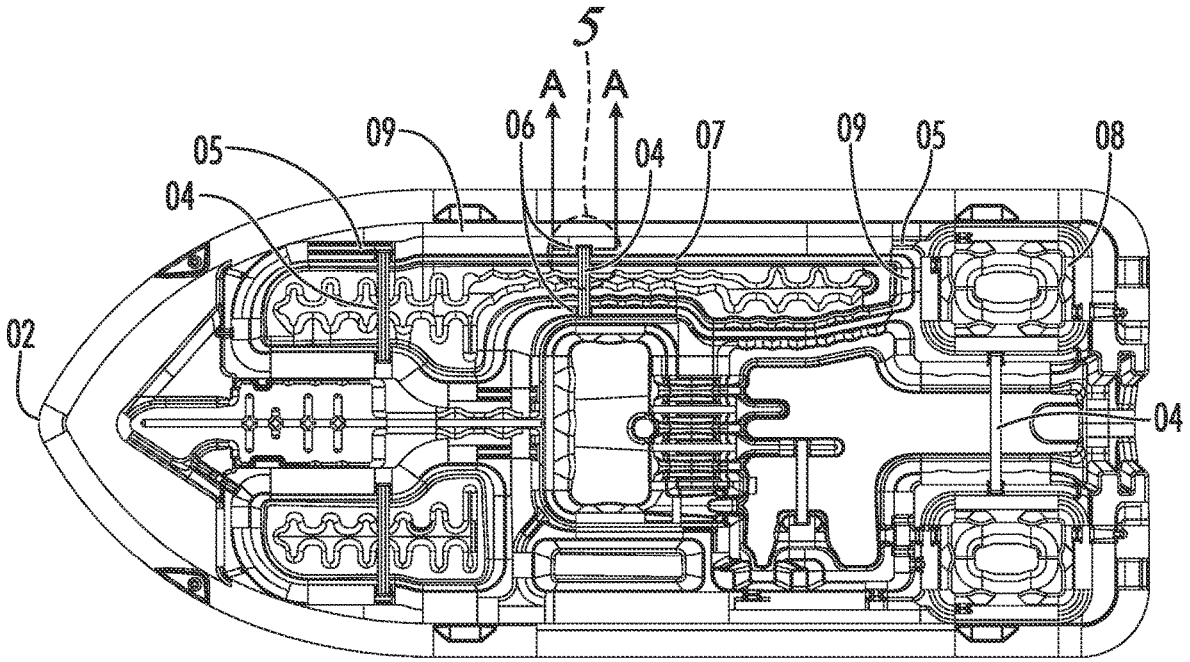
FIG. 2 is a top plan view of the rotational molded fishing boat in FIG. 1.
Figure 5:
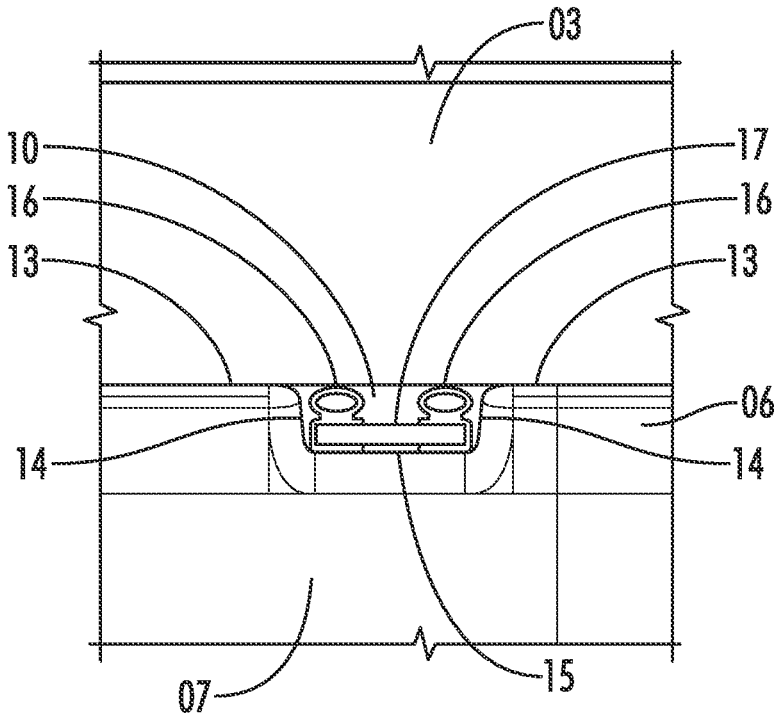
FIG. 5 is a transverse cross-section view of one of the notches and independent structural members taken along line A-A of FIG. 2.

In FIG. 2, a plan view of the boat from FIG. 1 is depicted, with reference to a section view A-A in FIG. 5.

Figure 3:
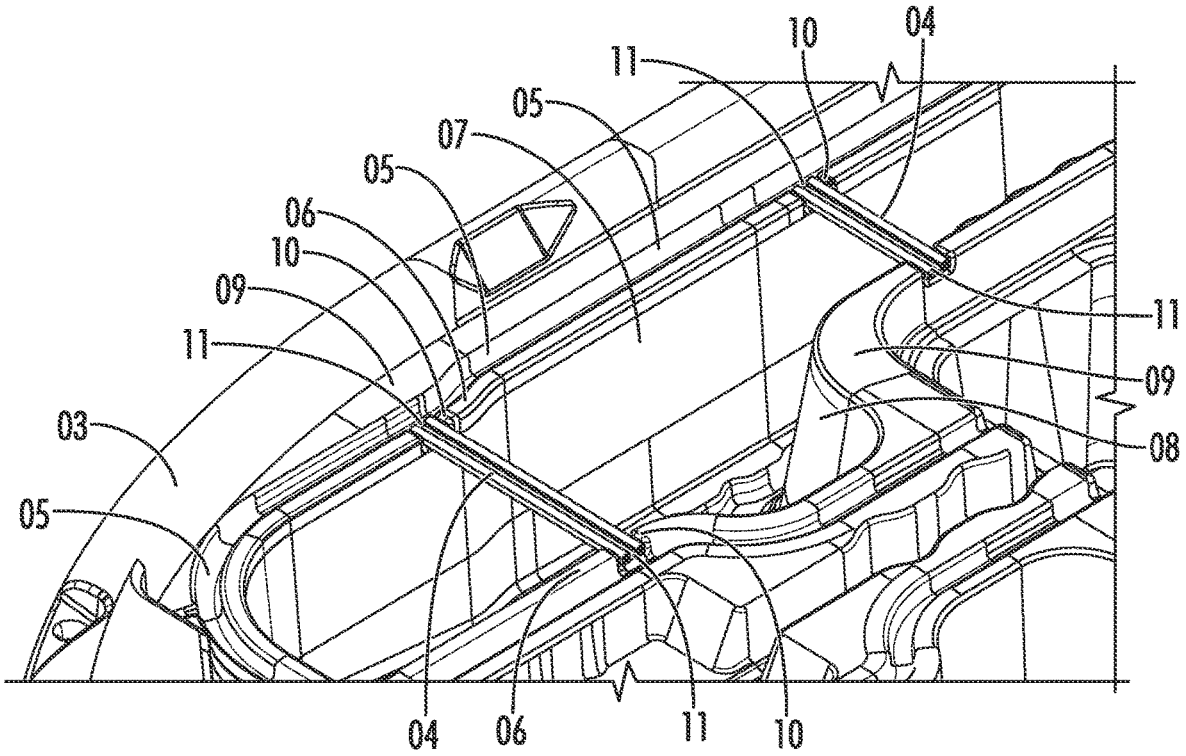
FIG. 3 is a close-up view of the forward end of the starboard compartment showing the independent structural member drain channels.

In FIG. 3, several molded-in notches in the raised lips 06 of the drain channels are illustrated, indicated generally by numeral 10. The notches 10 extend laterally through the raised lips 06 and include a pair of opposite side walls and a bottom wall. In the illustrated embodiment the notches 10 are located directly opposite one another on the port and starboard sides of the molded-in male cavity, and the bottom wall provides a flat mounting surface for the independent structural member drain channels 04. The channels 04 are then mechanically fastened to the molded plastic hull either via fasteners screwed directly into the plastic or with fasteners screwed into inserts molded into the plastic hull. Further, the spillover points for the independent drain channels 04 are depicted generally by numeral 11. These spillover points are at the ends of the independent drain channels 04 which are supported by the opposing notches, and allow entrapped water to fall either into a cavity 05 of the drain channels, or down along a transverse or longitudinal wall on the outside of the compartment. The bottom wall of molded-in notches 10 in raised lips 06 is positioned at a greater height or elevation than the associated cavity 05 in the peripheral drain channels. This prevents water in the peripheral drain channel from flowing into the storage compartment through the notches 10. By the notches 10 being higher than the peripheral drain channels, there is distance between the level of water in the peripheral drain channels and the flat part or bottom wall of the notches 10.

Figure 4:
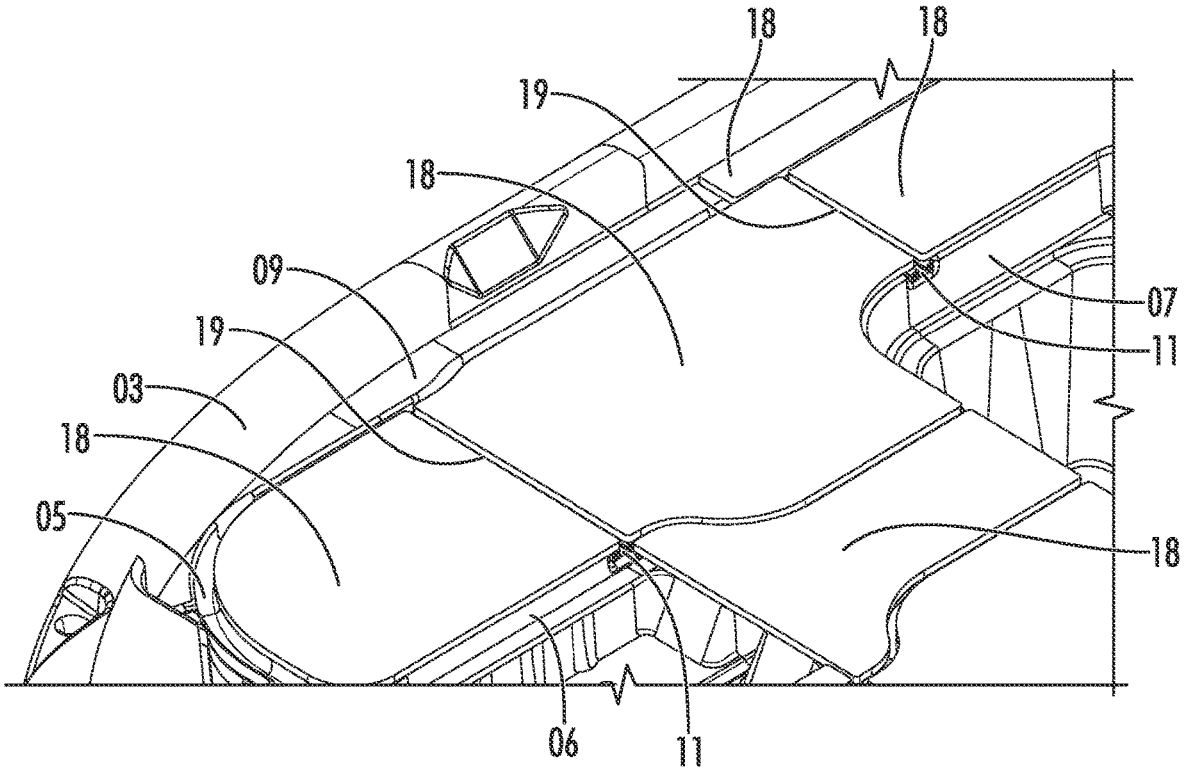
FIG. 4 is a close-up view of the forward end of the starboard compartment shown in FIG. 3, but various with deck panels shown installed.

In FIG. 4, various deck panels are shown installed over the molded-in storage compartments. The deck panels themselves are indicated generally by the numeral 18, while the seams between the deck panels 18 are indicated generally by the numeral 19. From this view, the strategic positioning of the independent structural member drain channels 04 beneath the seams between the deck panels is apparent. In an embodiment, the deck panels 18 will be held down by machine screws that are screwed into female threaded molded-in inserts in the plastic, while the hatches that enable access to the compartments will be affixed to adjoining deck panels via hinges.

In FIG. 5, a cross-section view of an independent structural member drain channel 04 fitting into its associated notch 10 in raised lip 06 is depicted. In this case, the independent structural member drain channel 04 includes a flat bar indicated by numeral 17 and a rubber seal or sealing member affixed to the side edges of flat bar 17 depicted by numeral 16. The notch 10 in raised lip 06 of the peripheral drain channel is designed in such a manner that its width and height facilitate the flush fitting of the flat bar 17 and its sealing member 16. The notch 10 is molded into the raised lip 06, with the top of raised lip 06 represented by numeral 13. The sides of the notch 10 are indicated by numeral 14 whereas the bottom of the notch 10 is indicated by numeral 15. The sealing member 16 extends from the upwardly facing surface of the flat bar 17 and is spaced apart on the opposite side edges of the flat bar 17 such that a channel is formed between the top surface of the flat bar 17 and the inwardly facing surfaces of the sealing member 16. In addition, the sealing member 16 is sized and positioned so as to be compressed against the bottom surface of the deck panels when placed over the compartments, such that there is no space or gap between the underside of the deck panel and the sealing member 16. As a result, the upper edge of the sealing member 16 will extend above the top 13 of the raised lip 06 when the deck panels are not placed over the compartments. In another embodiment, a hard rubber sealing member may be utilized, and this will still work, but a compressible sealing member is preferred. The sealing member 16 shown in FIG. 5 extends around the side edge and underside of the flat bar 17 and is of the "push-on" type that requires an edge to be pushed onto. In other embodiments, the sealing member 16 may consist of separate sealing members which are secured directly to the upwardly facing surface of the flat bar 17 by an adhesive or other suitable securing means.

Figure 6:
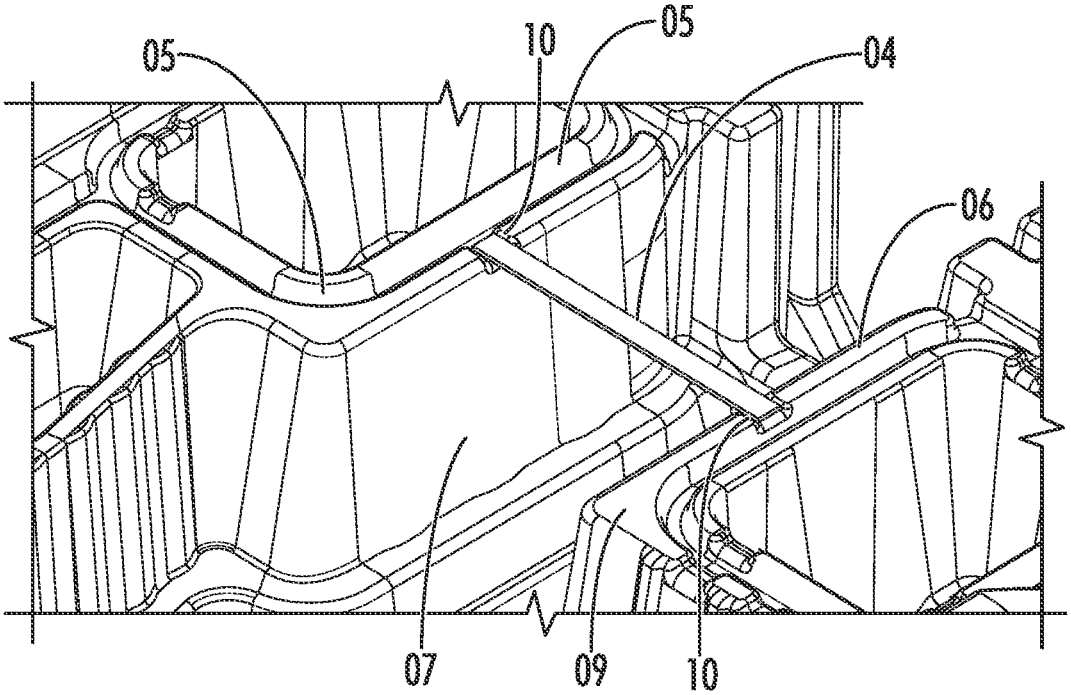
FIG. 6 is a close-up view of the aft portion of the boat showing an independent structural drain channel without a rubber seal.

In FIG. 6, an independent structural member drain channel is shown without a sealing member, illustrating a generic, purely structural application of the present invention to supporting a deck panel anywhere in the boat, such as over a battery compartment.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

What is claimed is:

1. A system for enabling both structural support and drainage of water away from seams between adjacent deck panels and hatches over uninterrupted molded-in compartments in a rotational molded boat hull without resorting to elaborate pre-fabricated decks, comprising:

one or more pairs of aligned molded-in notches formed in a peripheral edge of one of said molded-in compartments, said pairs of notches extending laterally through the peripheral edge and located on opposite sides of the compartment at a location in alignment with a seam to be formed between adjacent deck panels and/or hatches when secured over the compartment; and an independent structural member configured to be secured extending over the compartment with opposite ends supported in one of said pairs of notches, said structural member providing structural support for the deck panels or hatches to be secured over the compartment at said location.

2. The system of claim 1 additionally comprising a sealing member connected extending along a longitudinal length of the independent structural member, the sealing member and independent structural member defining a drainage channel between the sealing member and upwardly facing surface of the independent structural member in which water that falls in the seam between the adjacent deck panels and hatches is collected and drained.

3. The system of claim 2 in which the sealing member is dimensioned to press against an underside of the deck panel or hatch supported on the independent structural member.

4. The system of claim 3 in which a watertight seal between the sealing member and underside of the deck panel or hatch is formed.

5. The system of claim 4 in which one or more of the notches is formed in a raised lip extending around the peripheral edge of the compartment, wherein water draining from the independent structural member through the notch in the raised lip is directed into a peripheral cavity, wherein the raised lip and peripheral cavity form a drainage channel in the boat hull.

6. A rotational molded plastic boat hull comprising:

at least one uninterrupted male cavity positioned along a port or starboard side of the hull, said male cavity configured to serve as a storage compartment, a drain channel extending around at least a portion of a perimeter of said at least one male cavity, said drain channel having a raised lip portion adjacent the peripheral edge of the male cavity, and a drainage cavity along an outer edge of the raised lip portion;

a plurality of oppositely positioned transverse recessed notches, at least one of which is molded into the raised lip portion of the perimeter drain channel, one or more independent structural members having outer ends affixed to the plastic hull in said transverse notches, said independent structural members located both for supporting deck panels or hatches positioned over the male cavity and acting as drain channels which direct water away from seams between adjacent deck panels or hatches.

7. The boat hull of claim 6 additionally comprising a sealing member provided on opposing edges down the length of the independent structural members, said sealing members spaced apart wider than the seam between adjacent deck panels and forming a channel therebetween, allowing the entrapment of water that falls onto the independent structural member through the seam, and the subsequent drainage of said water away from the compartment.

8. The boat hull of claim 7 in which the one or more independent structural members is comprised of structural grade aluminum or steel.

9. A rotational molded plastic boat hull comprising:

an uninterrupted molded-in male cavity formed in the plastic hull;

a pair of aligned transverse notches formed in a perimeter of the male cavity, said notches including a mounting surface;

a structural member dimensioned to be secured extending over the male cavity with opposing ends supported on said mounting surface, said structural member including an upwardly open drain channel extending between said opposing ends;

wherein the structural member is positioned to provide structural support for adjacent deck panels or hatches secured over the male cavity, and the drain channel is positioned beneath a seam between said adjacent deck panels or hatches to collect water falling into the seam and direct the water away from the male cavity.

10. The rotational molded plastic boat hull of claim 9 additionally comprising a molded-in drain channel extending along at least a portion of the perimeter of the male cavity, said molded-in drain channel including a peripheral drainage cavity and a raised lip extending between the male cavity and the peripheral drainage cavity.

11. The rotational molded plastic boat hull of claim 10 wherein at least one of the aligned transverse notches extends through the raised lip to enable water in the drain channel of the structural member to drain into the peripheral drainage cavity.

12. The rotational molded plastic boat hull of claim 11 wherein both transverse notches in said pair of aligned transverse notches extend laterally through the raised lip of the molded-in drain channel.

13. The rotational molded plastic boat hull of claim 10 additionally comprising multiple pairs of aligned transverse notches formed in the perimeter of the male cavity.

14. The rotational molded plastic boat hull of claim 9 wherein the structural member is comprised of structural grade aluminum or steel.

15. The rotational molded plastic boat hull of claim 14 additionally comprising a sealing member extending along a longitudinal length of the structural member on opposite side edges of the structural member and defining the drain channel.

16. The rotational molded plastic boat hull of claim 15 wherein the sealing member extends outwardly from an upwardly facing surface of the structural member and is configured to press against an underside of the deck panels or hatches supported on the structural member.

17. The rotational molded plastic boat hull of claim 16 wherein a watertight seam is formed between the sealing member and underside of the deck panels or hatches on opposite sides of the seam.

18. The rotational molded plastic boat hull of claim 17 wherein the sealing member comprises a weatherstripping.

19. The rotational molded plastic boat hull of claim 9 additionally comprising a plurality of molded-in uninterrupted male cavities which male cavities are too large for a single deck panel or hatch to be practically used in covering said male cavities.

* * * * *